US011084145B2

(12) United States Patent
Schleusener et al.

(10) Patent No.: US 11,084,145 B2
(45) Date of Patent: Aug. 10, 2021

(54) GRIPPING OR CLAMPING DEVICE HAVING AN ACTUATOR

(71) Applicant: SCHUNK GMBH & CO. KG SPANN-UND GREIFTECHNIK, Lauffen Am Neckar (DE)

(72) Inventors: Tobias Schleusener, Eppingen (DE); Michael Drab, Unterägeri (CH)

(73) Assignee: SCHUNK GMBH & CO. KG SPANN-UND GREIFTECHNIK, Lauffen Am Neckar (DE)

( * ) Notice: Subject to any disclaimer, the term of this patent is extended or adjusted under 35 U.S.C. 154(b) by 372 days.

(21) Appl. No.: 15/765,743

(22) PCT Filed: Oct. 6, 2016

(86) PCT No.: PCT/EP2016/073869
§ 371 (c)(1),
(2) Date: Apr. 4, 2018

(87) PCT Pub. No.: WO2017/060345
PCT Pub. Date: Apr. 13, 2017

(65) Prior Publication Data

US 2019/0091836 A1 Mar. 28, 2019

(30) Foreign Application Priority Data

Oct. 6, 2015 (DE) ..... 10 2015 219 281.4

(51) Int. Cl.
*B25B 1/10* (2006.01)
*B25B 1/18* (2006.01)
*B25B 1/24* (2006.01)

(52) U.S. Cl.
CPC ..... *B25B 1/103* (2013.01); *B25B 1/18* (2013.01); *B25B 1/2489* (2013.01)

(58) Field of Classification Search
CPC .. B25B 1/00; B25B 1/18; B25B 1/103; B25B 1/2489
(Continued)

(56) References Cited

U.S. PATENT DOCUMENTS 4,591,199 A * 5/1986 Zajac ..... B25J 15/0253 269/32
6,585,247 B2 7/2003 Mattox et al.
(Continued)

FOREIGN PATENT DOCUMENTS

DE 4018194 C1 4/1991
DE 202004008799 U1 10/2005
(Continued)

OTHER PUBLICATIONS

International Search Report and Written Opinion Form PCT/ISA/210 and PCT/ISA/237, International Application No. PCT/EP2016/073869, pp. 1-10, International Filing Date Oct. 6, 2016, dated Feb. 6, 2017.

*Primary Examiner* — Lee D Wilson
*Assistant Examiner* — Alberto Saenz
(74) *Attorney, Agent, or Firm* — Bond Schoeneck & King, PLLC

(57) ABSTRACT

The invention relates to a gripping or clamping device having an actuator, including a drive driving the actuator, and at least one jaw that is motion-coupled with the actuator. The actuator includes a spindle having a threaded portion, wherein for the purpose of motion coupling, an active portion meshing the threaded portion is arranged on the jaw side.

15 Claims, 4 Drawing Sheets

(58) Field of Classification Search
USPC ..... 269/43, 45, 156, 240, 246, 255
See application file for complete search history.

(56) References Cited

U.S. PATENT DOCUMENTS

| | | | | |
|---|---|---|---|---|
| 8,303,007 | B2 * | 11/2012 | Fukano | B25J 15/0273 294/119.1 |
| 2002/0005609 | A1 | 1/2002 | Mattox et al. | |

FOREIGN PATENT DOCUMENTS

| | | | |
|---|---|---|---|
| DE | 102012208720 | A1 | 11/2013 |
| DE | 202015103174 | U1 | 6/2015 |
| EP | 0411427 | A1 | 7/1990 |

* cited by examiner

GRIPPING OR CLAMPING DEVICE HAVING AN ACTUATOR

CROSS-REFERENCE TO RELATED APPLICATIONS

This application is the United States National Phase Application of PCT Application No. PCT/EP2016/073869, filed Oct. 6, 2016, which relates and claims priority to German Application No. DE102015219281.4 filed Oct. 6, 2015, the entire disclosure of which is incorporated herein by reference.

BACKGROUND OF THE INVENTION

The invention relates to a gripping or clamping device having an actuator, having a drive that drives the actuator, and having at least one jaw coupled in movement with the actuator, the actuator comprising a spindle having a threaded portion.

Gripping or clamping devices of this type are previously known for example from DE 10 2012 208 720 A1. Therein, a spindle drive is accommodated in a housing of the gripping or clamping device, and comprises a rotatable spindle and at least one spindle nut that is arranged fixed in rotation but displaceable in the movement direction and that cooperates with at least one movable base jaw.

Gripping or clamping devices of this type are comparatively complex to manufacture, require a relatively large amount of installation space, and are of a relatively high weight.

U.S. Pat. No. 6,585,247 B2 discloses a clamping device that has a jaw on which a support element is provided, which cooperates with a threaded portion of a drivable shaft to move the jaw.

An object of the invention is therefore to develop a gripping or clamping device of the stated type in such a way that they are of a smaller construction, are of a lower weight, and are less complex to produce.

SUMMARY OF THE INVENTION

This object is achieved by a gripping or clamping device. It is therefore provided that a working portion that meshes with the threaded portion is arranged on the jaw side for the movement coupling. As a result, a comparatively compactly constructed gripping or clamping device can be provided that can be manufactured with a relatively low complexity of production and that additionally is of a comparatively low weight. By contrast with DE 10 2012 208 720 A1, there is direct movement coupling between a working portion arranged on the jaw side and the thread portion of the spindle. A spindle nut that fully surrounds the spindle is superfluous. The gripping or clamping device can thus in particular be of a narrower construction. Further, this brings about a reduction in weight and a reduction in the complexity of production.

The working portion may in particular be formed as a toothed rod portion or as a spindle nut portion that extends over a particular circumferential portion.

According to the invention, the diameter of the thread portion is greater than the extent of the working portion transverse to the movement direction of the jaw. This measure also contributes to the gripping or clamping device being of a particularly compact construction.

Particularly advantageously, the actuator is coupled in movement with two jaws. In this case, the actuator may comprise a spindle having two oppositely directed thread portions that each cooperate with a jaw. As a result, the jaws can be moved toward and away from one another synchronously. As a result, not only is a gripping or clamping device of a particularly compact construction provided, but at the same time movement synchronization of the jaws, which are driven by a single drive, is achieved. On the other hand, it is conceivable for the gripping or clamping device according to the invention to have only one jaw or else three jaws that are moved toward one another synchronously.

In particular, it is conceivable for the drive to comprise a motor having a drive shaft, the drive shaft and the actuator having axes of rotation that extend mutually parallel. The motor may in particular be an electric motor. As a result of this too, a particularly compact construction can be achieved. Advantageously, the motor, along with the drive shaft, and the actuator are arranged one vertically above the other.

In this case, the axes of rotation of the drive shaft and of the actuator may be arranged extending parallel to the movement direction of the jaw. This also contributes to a particularly compact construction.

It is further conceivable for a drive transmission having at least one transmission element to be provided between the drive and the actuator. This may in particular be a spur gear transmission, it being possible for the transmission element to be formed as a shaft having a gearwheel. Particularly advantageously, the axis of rotation of the transmission element extends parallel to the axis of rotation of the transmission element. Particularly advantageously, the axes of rotation of the actuator, of the drive shaft and of the transmission element or if present the plurality of transmission elements extend mutually parallel.

The working portion may in particular have a straight or oblique toothing. A wide range of tooth shapes, such as wedge (flank angle in particular 60°) or trapezoid tooth shapes, are conceivable in this case. Modular toothings (for example 20°), trapezoid threads, pointed toothings or the like are likewise conceivable.

It has been found to be particularly advantageous for there to be an oblique toothing and for the pitch angle of the threaded portion to be identical to the pitch angle of the oblique toothing. As a result, a particularly advantageous force transmission between the actuator and the jaw can be provided. The angle of inclination may in particular be between 1° and 7°, in particular between 3° and 4°. For small angles of inclination of this type, there is highly effective self-inhibition between the working portion and the threaded portion, in such a way that the jaw is fixed without the use of a braking unit when the drive is unactuated. In this case, a comparatively high gripping force can be maintained in a particularly simple manner.

Advantageously, the outer contour of the oblique toothing is formed complementary to the outer contour of the threaded portion. This too makes it possible to provide particularly advantageous movement coupling.

Advantageously, a resiliently yielding spring element is provided between the jaw and the working portion. In this case, the actuator and/or the drive and/or the drive transmission may be fixable by means of a braking unit. As a result, a gripping force can be maintained. The spring element may in particular be arranged under bias between the working portion and the jaw. In particular, the working portion may have two mutually opposing narrow faces that extend transverse to the movement direction of the jaw and that each cooperate with a spring element.

In this case, it is conceivable in particular for the spring element to extend in a groove that extends transverse to the movement direction of the jaw and that is defined by the jaw on one side and the working portion on the other side. The groove may in particular be of rectangular or square cross section. The spring element may therefore be formed as a cylinder having a rectangular or square base face.

In a particularly advantageous embodiment of the invention, the jaw is guided in a jaw guide of a base housing. In this case, the actuator may be arranged below the jaw guide in the base housing. Particularly advantageously, the drive, the actuator and the jaw guide are arranged vertically above one another in the base housing. As a result, a particularly compact gripping or clamping device may be provided.

Further details and advantageous embodiments of the invention may be derived from the following description, in which an embodiment of the invention is described and explained in greater detail.

DETAILED DESCRIPTION

Figure 1:
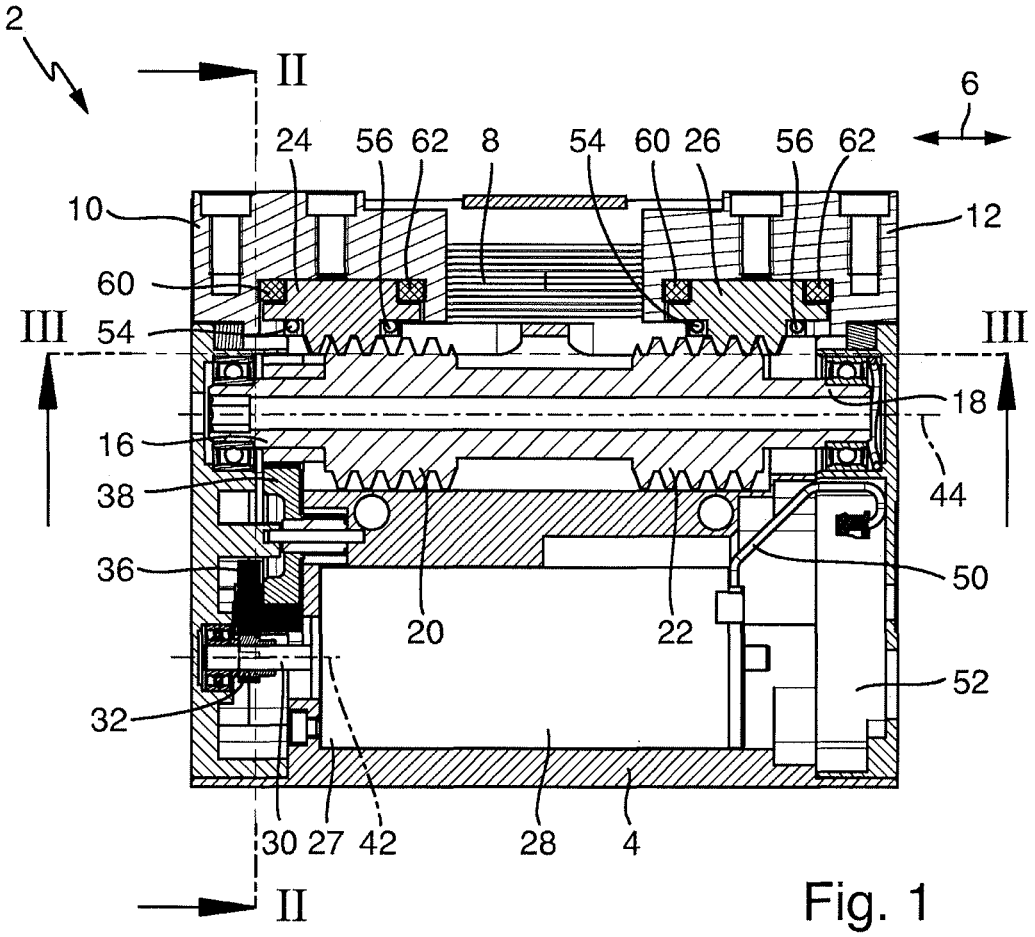
FIG. 1 is a longitudinal section through a parallel gripper.
Figure 2:
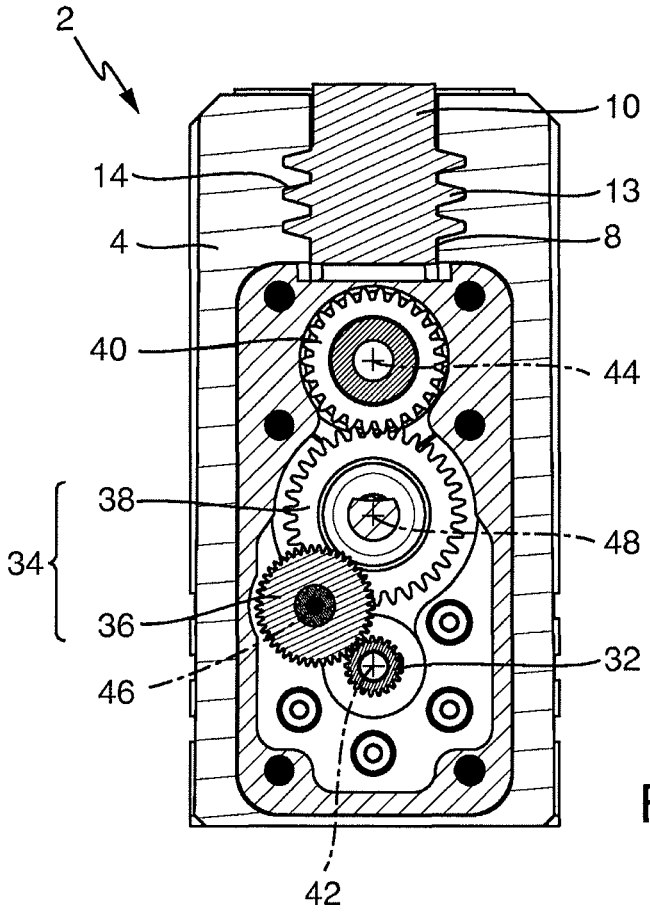
FIG. 2 is a section along the line II-II of FIG. 1.
Figure 3:
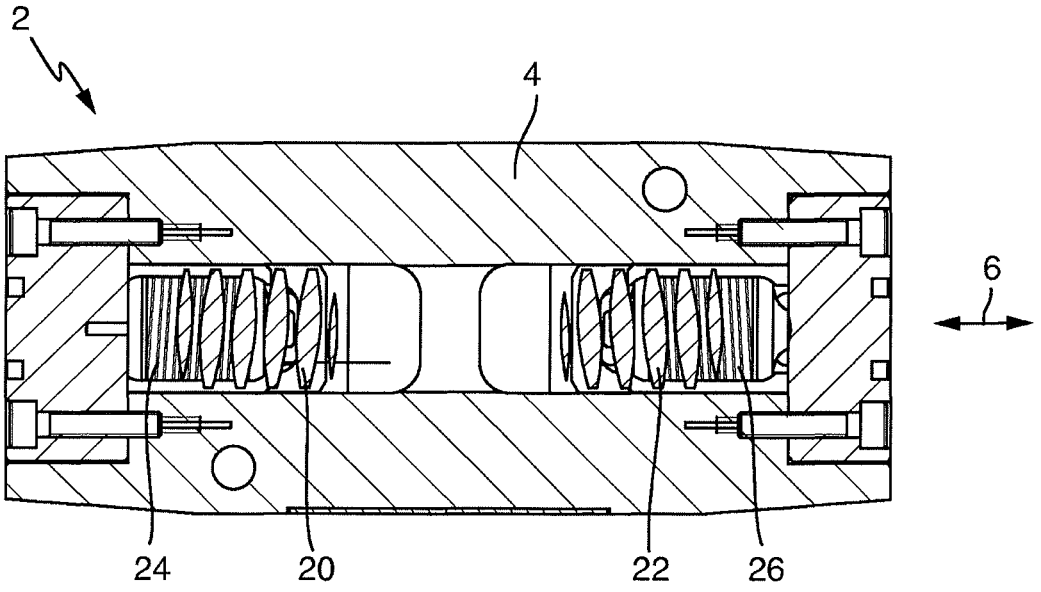
FIG. 3 is a section along the line of FIG. 1.

FIGS. 1 to 3 show a gripping device 2 formed as a parallel gripper. This comprises a base housing 4 having a jaw guide 8 that extends in a longitudinal direction 6 for gripper jaws 10, 12 that are insertable into the jaw guide 8 in the longitudinal direction and displaceably mounted therein. The longitudinal direction 6 also corresponds to the displacement direction 6. Mounting openings, for detachably attaching gripping finger elements in the broadest possible sense, are provided on an upper face of the gripper jaws 10, 12, and will not be described further herein.

As is clear from FIG. 2, the gripper jaws 10, 12 each comprise guide webs 13 extending in the displacement direction 6 on both sides, three guide webs 13, which are arranged above one another transverse to the displacement direction 6 and extend over the entire length of the gripper jaws 10, 12, being provided on both sides. As can further be seen from FIG. 2, the jaw guide 8 in the gripper housing 4 has guide grooves that are formed complementary to the guide webs 12 and in which the guide webs 13 can engage and slide in the displacement direction 6, the guide webs 13 engaging in the guide grooves 14 substantially without play.

For displacing the jaws 10, 12, an actuator 16 is coupled in movement with the jaws 10, 12, the actuator 16 having a spindle 18 having two oppositely directed thread portions 20, 22, which can be seen particularly clearly in FIGS. 1 and 3. For the movement coupling, a toothed rod portion 24, 26 that meshes with the thread portion 20, 22 is arranged on the jaws 10, 12 on the jaw side in each case (cf. FIG. 1). By contrast with the prior art, there is direct movement coupling between the toothed rod portions 24, 26 arranged on the jaw side and the threaded portions 20, 22 of the spindle. A spindle nut that fully surrounds the spindle is entirely superfluous. The gripping device 2 can thus in particular be of a narrower construction. Further, this brings about a reduction in weight and a reduction in the complexity of production and assembly. Further, synchronous movement of the two jaws 10, 12 by means of the actuator 16 is made possible.

As can be seen from FIG. 1, the actuator 16 is driven by a drive 27 that comprises an electric motor 28 and a drive shaft 30 having a gearwheel 32.

As can be seen from FIG. 2, a drive transmission 34 formed as a spur wheel transmission is provided with two transmission elements 36, 38 between the drive 27 and the actuator 16. The first transmission element 36 cooperates with the drive pinion 32, whilst the second transmission element 38 cooperates with a gearwheel 40 arranged on the spindle 18.

As can be seen from FIGS. 1 and 2, the axes of rotation 42, 44 of the drive shaft 30 and of the actuator 16 extend parallel to the movement direction 6 of the jaw. The axes of rotation 46, 48 of the transmission elements 36, 38 also extend parallel thereto. Further, the axes of rotation 42, 44, 48 of the drive shaft 30, of the actuator 16 and of the second transmission element 38 lie in a shared plane that forms a central longitudinal plane of the parallel gripper 2. Further, the drive 27, the actuator 16 and the jaw guide 8 are arranged vertically above one another.

The electric motor 28 is controllable via a circuit board 52, the circuit board 52 being connected to the motor 28 via a wired connection 50. The circuit board 52 is positioned on the side of the motor 28 facing away from the drive shaft 30 in the displacement direction 6.

Figure 5A:
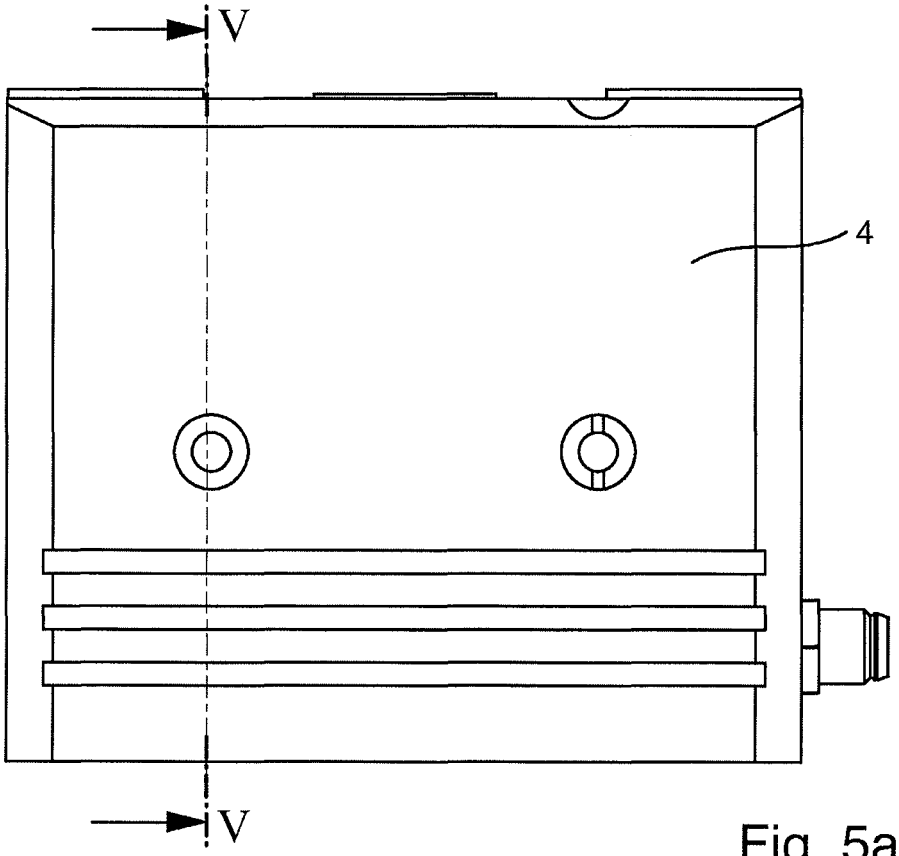
FIG. 5*a* is a side view of the parallel gripper of FIG. 1.
Figure 5B:
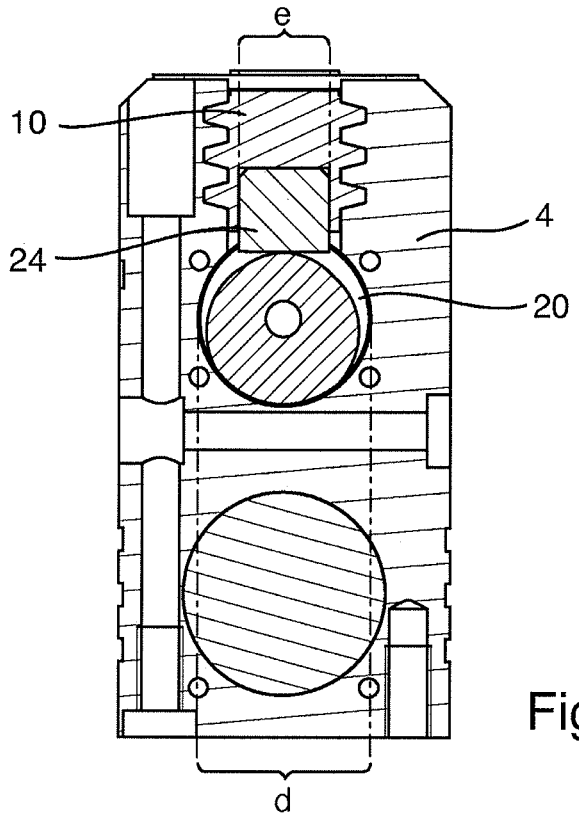
FIG. 5*b* is a section along the line V-V of FIG. 5*a;*

As can be seen from FIGS. 5*b* and 5*c*, the diameter d of the threaded portion 20, 22 is greater than the extent e of the toothed rod portion 24, 26 transverse to the movement direction 6 of the jaws 10, 12, the actuator 16 being arranged below the jaw guide 8 in the base housing 4. As can be seen in particular from FIG. 1, the jaw guide 8 has an open lower face.

Figure 4:
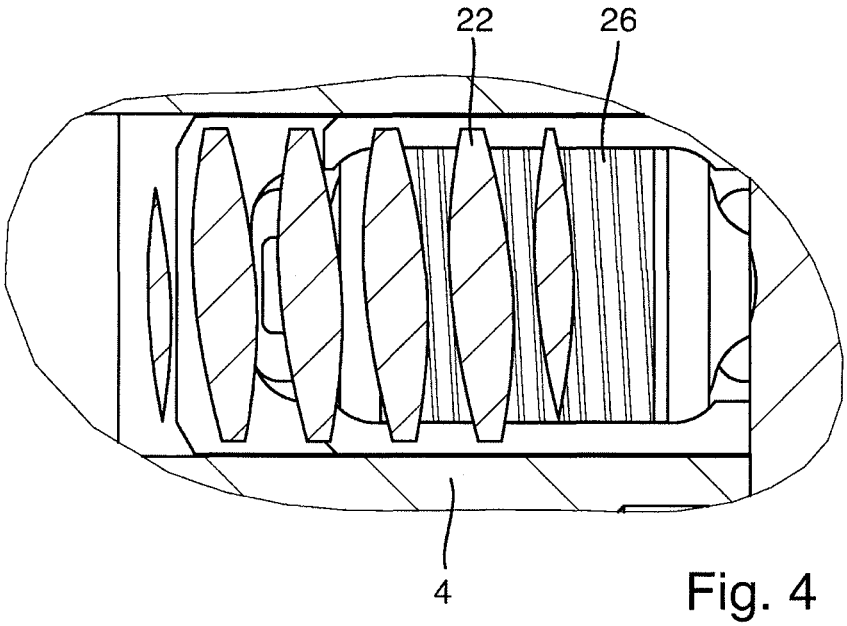
FIG. 4 is an enlarged drawing of a detail of the drawing of FIG. 3.

In FIGS. 1, 3 and 4 it can further be seen that the threaded portion 20, 22 is formed as a screw having a plurality of screw threads, the pitch angle being approximately 3.5°. The toothed rod portions 24, 26 also have an inclined toothing having this same pitch angle.

As can be seen from FIG. 1, the toothed rod portions 24, 26, each having two rods 54, 56 extending transverse to the displacement direction 6, are arranged on the jaws 10, 12, in such a way that the rods 54, 56 form a suspension for the toothed rod portions 24, 26.

The toothed rod portions 24, 26 each have two mutually opposing narrow faces that extend transverse to the movement direction 6 of the jaws 10, 12. On each narrow face, as can be seen in FIG. 1, two spring elements 60, 62 are provided, between which, as seen in the movement direction 6 of the jaws 10, 12, a toothed rod portion 24, 26 is provided in each case. The spring elements 60, 62 are arranged in grooves that are defined by the jaws 10, 12 on one side and by the toothed rod portions 24, 26 on the other side. As can be seen from FIG. 1, the narrow faces of the toothed rod portions 24, 26 are spaced apart slightly from the jaws 10, 12.

The spring elements 60, 62 are formed in particular as resilient elastomer blocks. In this case, the actuator can be fixed by a braking unit (not shown) in particular when the maximum deformation or at least almost the maximum deformation of the spring elements 60, 62 is reached. In addition, the self-inhibition between the toothed rod portions 24, 26 and the threaded portions 20, 22 may also be sufficient to fix the jaws, in such a way that no braking unit need be used. As a result, gripping force can be almost fully maintained, or a gripping force can be provided that is greater than a gripping force supplied purely by the drive 27.

As a result of the actuator 16 comprising a spindle 18 having two oppositely directed thread portions 20, 22 that each cooperate with a jaw 10, 12, the jaws 10, 12 can be moved toward and away from one another synchronously.

Figure 5C:
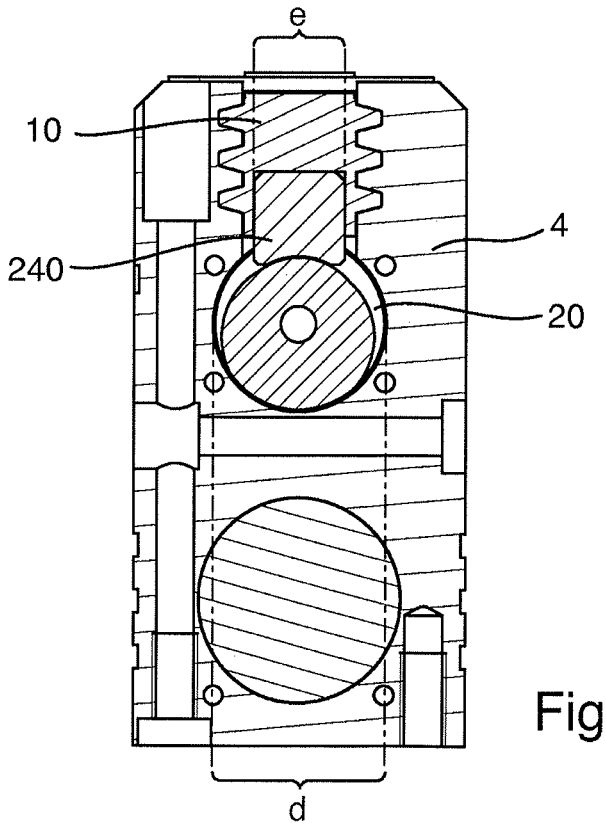
FIG. 5*c* is a section along the line V-V of FIG. 5*a*, showing a different variant of the working portion from FIG. 5*b*.

FIG. 5*c* shows a variant of the working portion 240. The working portion 240 is formed as a spindle nut portion that extends over a circumferential portion and that has straight toothing. As a result, an enlarged contact area between the threaded portion 20 and the working portion 240 is provided.

Overall, with the invention a gripping or clamping device of a compact construction can be provided that is comparatively simple to manufacture and of comparatively low weight, the jaws 10, 12 being moved synchronously.

What is claimed is:

1. Gripping or clamping device having an actuator, having a drive that drives the actuator, and having at least two jaws that are coupled for movement in a movement direction with the actuator and that can be moved in movement direction toward and away from one another synchronously, the actuator comprising at least one spindle having at least two threaded portions, characterized in that a working portion that meshes with the threaded portion is arranged on the jaw side in each case for the movement coupling, and further having a drive pinion and a drive transmission, the drive transmission having first and second transmission elements being provided between the drive and the actuator, the first transmission element cooperating with the drive pinion and the second transmission element cooperating with a gearwheel arranged on the spindle, wherein the diameter of each threaded portion being greater than an extent of the associated working portion transverse to the movement direction of the jaw.

2. Gripping or clamping device according to claim 1, characterized in that the working portion is formed as a toothed rod portion.

3. Gripping or clamping device according to claim 1, characterized in that two jaws that are coupled in movement with the actuator are provided and in that the actuator comprises at least one spindle having two oppositely directed thread portions that each cooperate with one jaw.

4. Gripping or clamping device according to claim 1, characterized in that the drive comprises a motor having a drive shaft, the drive shaft and the actuator having axes of rotation that extend mutually parallel.

5. Gripping or clamping device according to claim 4, characterized in that the axes of rotation of the drive shaft and of the actuator extend parallel to the movement direction of the jaw.

6. Gripping or clamping device according to claim 1, characterized in that the axis of rotation of the transmission element extends parallel to the axis of rotation of the actuator.

7. Gripping or clamping device according to claim 1, characterized in that the working portion has an oblique toothing.

8. Gripping or clamping device according to claim 7, characterized in that the pitch angles of the threaded portion and of the oblique toothing are identical.

9. Gripping or clamping device according to claim 8, characterized in that the pitch angle is between 1° and 7°.

10. Gripping or clamping device according to claim 1, characterized in that the outer contour of the oblique toothing is formed complementary to the outer contour of the threaded portion.

11. Gripping or clamping device according to claim 1, characterized in that a resiliently yielding spring element is provided between the jaw and the working portion wherein the resiliently yielding spring is arranged in grooves that are defined by the jaws on one side and by toothed rod portions on the other side.

12. Gripping or clamping device according to claim 11, characterized in that the spring element extends in a groove that extends transverse to the movement direction of the jaw and that is defined by the jaw on one side and the working portion on the other side.

13. Gripping or clamping device according to claim 1, characterized in that the jaw is guided in a jaw guide of a base housing, the actuator being arranged below the jaw guide in the base housing.

14. Gripping or clamping device according to claim 13, characterized in that the drive, the actuator and the jaw guide are arranged substantially vertically above one another in the base housing.

15. Gripping or clamping device according to claim 1, characterized in that the working portion has a straight toothing.

* * * * *